United States Patent [19]

Herzog

[11] Patent Number: 5,054,260

[45] Date of Patent: Oct. 8, 1991

[54] HIGH SPEED SEALING MACHINE

[75] Inventor: James M. Herzog, Lancaster, Ohio

[73] Assignee: Anchor Hocking Packaging Company, N.J.

[21] Appl. No.: 538,026

[22] Filed: Jun. 13, 1990

[51] Int. Cl.[5] ..... B67B 3/20; B65B 7/28

[52] U.S. Cl. ..... 53/307; 53/308; 53/317

[58] Field of Search ..... 53/306, 307, 308, 317, 53/331.5, 282, 310

[56] References Cited

U.S. PATENT DOCUMENTS

| | | | |
|---|---|---|---|
| 1,040,615 | 10/1912 | Brown . | |
| 1,470,348 | 10/1923 | Clark | 53/308 X |
| 1,748,961 | 3/1930 | Risser | 53/308 X |
| 3,111,798 | 11/1963 | Weller | 53/306 |
| 3,143,835 | 8/1964 | McElroy . | |
| 3,280,534 | 10/1966 | Hildebrandt et al. | 53/331.5 X |
| 3,392,505 | 7/1968 | Luther | 53/307 |
| 3,422,597 | 1/1969 | Beer | 53/307 X |
| 3,427,785 | 2/1969 | Osterhage | 53/317 X |
| 3,438,174 | 4/1969 | Foss et al. | 53/317 X |
| 3,628,307 | 12/1971 | Croasdale et al. | 53/307 X |
| 3,712,023 | 1/1973 | Bryan, Jr. et al. | 53/307 |
| 3,837,141 | 9/1974 | Lorieux | 53/307 |
| 3,939,625 | 2/1976 | Remele et al. | 53/307 X |
| 3,955,341 | 5/1976 | Wilhere | 53/317 X |
| 4,065,909 | 1/1978 | Mueller . | |
| 4,199,914 | 4/1980 | Ochs et al. | 53/317 X |
| 4,279,115 | 7/1981 | Roberts et al. . | |
| 4,357,787 | 11/1982 | Long | 53/317 |
| 4,548,668 | 10/1985 | Roth et al. | 53/309 X |
| 4,696,143 | 9/1987 | Young . | |
| 4,848,060 | 7/1989 | Kubis et al. | 53/307 X |

*Primary Examiner*—Horace M. Culver

*Attorney, Agent, or Firm*—Wood, Herron & Evans

[57] ABSTRACT

Apparatus for applying closures to containers held by grippers and moving in a row on a conveyor. The closures are fed from a supply into pockets on a star wheel which delivers them to closure carriers mounted to an applicator wheel which rotates in a plane parallel to and above the closure path of movement, about an axis perpendicular to that of the star wheel. Rotation of the closures carried by the carriers on the applicator wheel is synchronized with the rate of movement of the containers, and the closures are brought into converging alignment with the containers. The applicator wheel has optional means for pressing the closure partially or wholly to a final applied position on the containers, and/or for rotating them while still carried by the carriers to desired torque level.

13 Claims, 7 Drawing Sheets

HIGH SPEED SEALING MACHINE

FIELD OF THE INVENTION

This invention relates to machines for placing and sealing closures onto containers, and more particularly to an improved high speed sealing machine which applies closures onto containers at significantly higher speeds than heretofore accomplished without putting undue stress on the closure or the container and while maintaining the integrity of the sealing operation, thereby reducing rejects.

BACKGROUND OF THE INVENTION

Various "straight line" sealing machines for applying closures onto containers are disclosed in U.S. Pat. Nos. 3,143,835, 3,274,748, 3,438,174, 4,199,914, 4,279,115 and 4,716,708. These machines generally include a linear horizontal conveyor which carries filled open containers in a row sequentially through a closure feeding device, a closure applicator and a closure sealing means. The closure feeding device typically feeds or presents the closures to the moving containers via a chute or slide mechanism. As the containers are moved by the conveyor, the leading edge of a respective presented closure is engaged by the leading edge of the top of a respective container. The continuing movement of the container pulls the closure from its feed position so that it is seated on the container. Subsequently, means known per se press the closures onto the containers and/or rotate the closures onto the containers to seal the containers.

The maximum practical operating speed for previous machines of this type has been limited due to the nature of the closure feeding and application devices. When operated at desirable higher speeds, the reliability and accuracy with which the closures are engaged and seated upon the container tops is diminished. In particular, at very high speeds (for example, about 1,200 containers per minute) the impact of the leading edge of the container on the leading edge of the closure not only draws the closure from the feed position but may also "throw" or dislodge the closure so that the closure is not seated on the container whatsoever. Alternatively, the closure may end up "cocked" or improperly seated on the container as a result of which it cannot be properly sealed by the subsequent application and sealing means.

Other types of "straight line" sealing machines are disclosed in U.S. Pat. No. 3,392,505 and 4,696,143. The '505 patent is directed to a dual head apparatus for applying closures to containers. The disclosed apparatus includes a transfer head for removing closures from a dispenser and transferring them to an inserter head, which, in turn, applies the closures to containers. During the transferring step, the closures are each reoriented about a transverse axis so that they may be presented with their bottom side facing towards the opening of the containers to which they will be applied. The complexity of the closure pick-up and transfer mechanism of this machine does not lend itself to effective high-speed capping.

The '143 patent is directed to a container capping apparatus and includes a rotating carriage that receives the container caps from a conveyor and subsequently applies those caps to containers moving on a second conveyor. This machine is designed and operated such that the rotating carriage has a tangential velocity proximate the container conveyor that exceeds the linear velocity of the container conveyor, and thus the speed of the containers on the conveyor is wholly controlled by the rotating carriage at the location whereat the caps are applied to the containers. This machine is likewise not capable of effective high-speed capping.

What is needed is an improved sealing machine that can be operated at speeds heretofore not reliably attainable, while maintaining the integrity of the sealing operation with relatively few rejections.

SUMMARY OF THE INVENTION

The sealing machine of the present invention overcomes the drawbacks mentioned above which occur when prior art sealing machines are operated at very high speeds. The machine of the present invention can reliably apply between about 400–2,000 closures per minute (depending upon the type of closures). This is accomplished by providing positive, in-time or synchronized placement of the closures onto the containers by a closure applicator which is fed closures by a synchronized closure feeding means.

In a preferred embodiment, the sealing machine of the present invention includes a novel arrangement of a closure feeding means and closure applicator in combination with a conveyor in a straight line sealing machine which moves containers in a row along a line of movement. The closure applicator is an applicator wheel positioned above the conveyor and rotatable about an axis transverse (cross-wise) to the line of movement of the conveyor. The applicator wheel has a plurality of closure carriers around its periphery and is driven by a drive which rotates the applicator wheel at a rate such that the linear speed of the carriers (and thus the closures carried in them) matches that of the containers on the conveyor.

A preferred closure feeding means is a "star wheel", or notched wheel, for feeding closures from a source to the closure carriers on the periphery of the applicator wheel. Preferably, the star wheel has a plurality of pockets around its periphery for receiving closures from a closure source and positively delivering them to the closure carriers at a first rotational position of the applicator wheel without any reorientation of the closures during the delivery. The star wheel rotates about an axis transverse to the axis of rotation of the applicator wheel and parallel to the line of movement of the containers on the conveyor. The plane of closure movement from the closure source into the star wheel is parallel to the plane of the star wheel and perpendicular to the plane of the applicator wheel. The star wheel and the applicator wheel are both rotated in synchronism with the movement of the conveyor.

While the sealing machine of the present invention can be used for sealing many types of containers, it is especially suitable for applying closures having continuous threads or lugs onto containers having a threaded finish. In such use, the applicator wheel is positioned above the conveyor a predetermined distance such that the closures carried by the carriers are brought sequentially into converging alignment with the tops of the respective containers as the applicator wheel rotates and the conveyor advances the containers, to position each closure on the top of a respective container on the conveyor. Alternatively, the applicator wheel may be spaced above the tops of the containers and each closure pressed downward from it, when the closure is in vertical alignment with the container, onto the finish of the respective container to an at least partially applied position.

The sealing machine of the present invention may be used with means for rotating the closures into a final tightened or sealed position on the containers. Suitable devices to accomplish such closure tightening are known. These include the twin side belt unit described in U.S. Pat. No. 4,199,914, which includes differentially speeded belts extending parallel to the line of movement of the conveyor which engage opposite sides of the closures to rotate the closures onto the containers, and the belt and drag shoe unit disclosed in U.S. Pat. No. 3,438,174, which includes a friction surface and a rotating belt side-by-side which engage the top of the closure and rotate it onto the container finish. One or both of the above closure rotating devices can be used in conjunction with the sealing machine of the present invention to rotate the closures to a final applied position by calibrating or adjusting the device to rotate the closures to a predetermined torque.

In an alternative embodiment, the applicator wheel has a plurality of spindles which extend radially outwardly on the applicator wheel and each spindle has a closure carrier at its distal end. Closures are delivered or fed to the carriers by the star wheel at a first rotational position of the applicator wheel without any reorientation of the closures during this delivery and the closures are seated onto respective containers at a second rotational position of the applicator wheel. In this embodiment, each spindle is rotatable about its own longitudinal axis and each closure is rotated onto the container finish by rotating the spindle when the closure converges with the container. Additionally, each spindle may reciprocate axially as the closure converges with the container to thereby press the closure onto the container finish to a partially applied position.

Further features and advantages of the present invention will become apparent with reference to the accompanying drawings and the ensuing detailed description thereof.

DETAILED DESCRIPTION OF THE DRAWINGS

The improved sealing machine of the present invention has the capability of applying closures onto containers at the rate of between about 400–2,000 closures per minute, with minimal rejections, depending upon the type of containers and closures used. The containers are usually glass or molded plastic and have a finish or threaded portion at the top or neck thereof. Suitable closures include metal twist caps, molded plastic caps or composite caps having a molded plastic ring or shell and a metal disk cover seated in the ring. These types of closures generally have threads or lugs for engaging the finish on the container. As will be described in greater detail below, using the sealing machine of the present invention, the closures may be pressed onto the container finish to a partially applied position and subsequently rotated to a final applied position, or they may simply be positioned on the tops of the containers and subsequently rotated to a final applied position.

Figure 1:
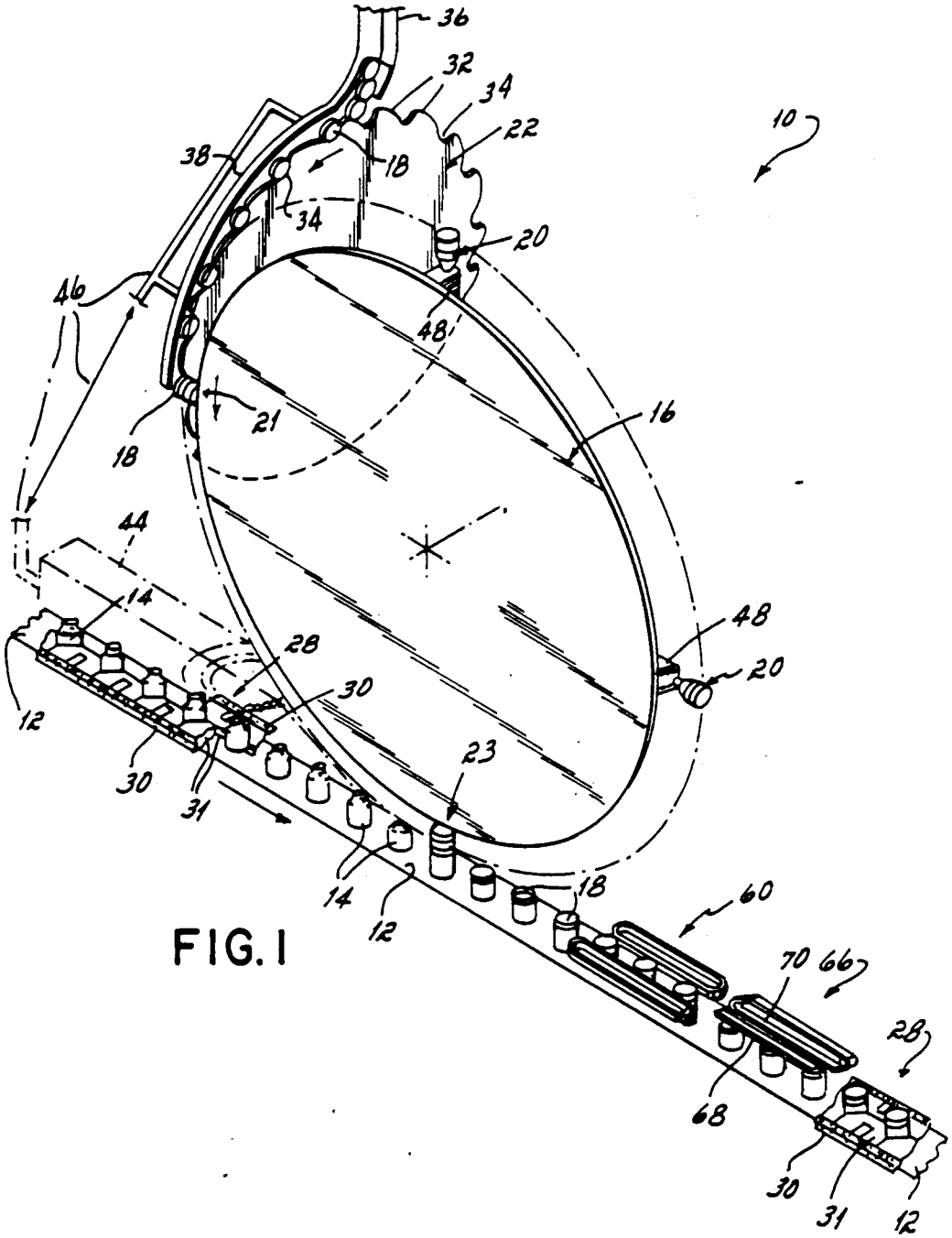
FIG. 1 is a perspective diagrammatic view of one embodiment of the sealing machine of the present invention.
Figure 2:
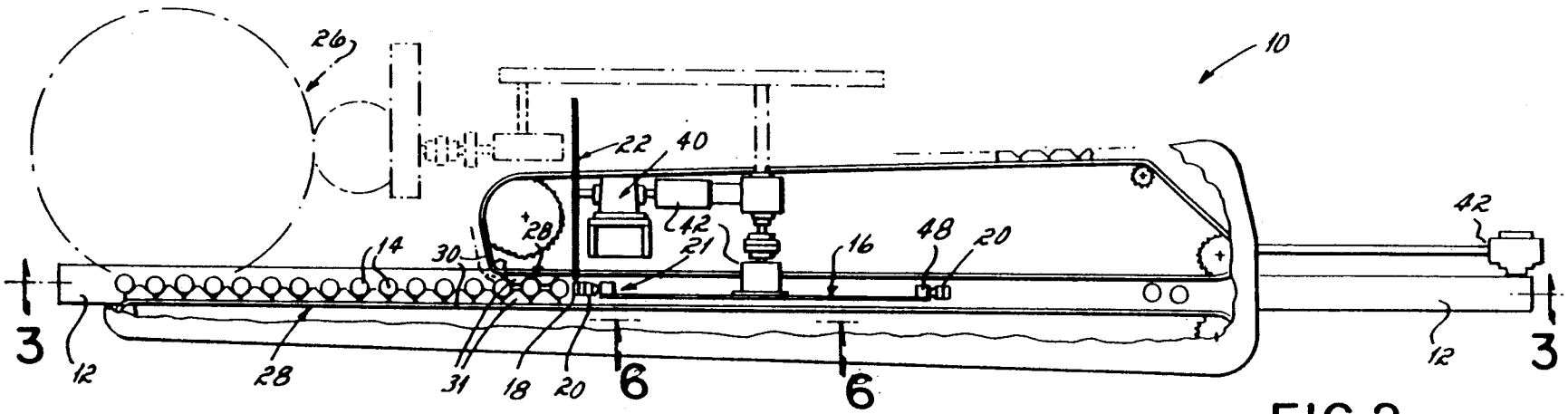
FIG. 2 is a top plan view of the sealing machine shown in FIG. 1.
Figure 3:
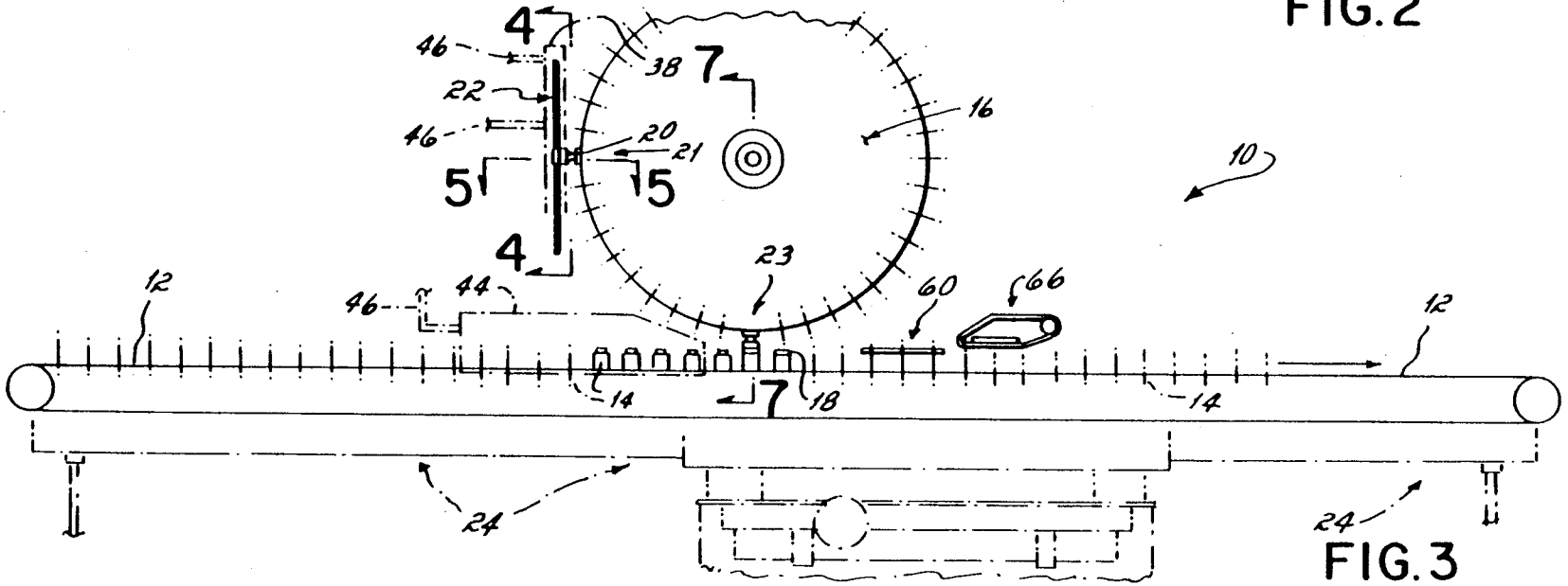
FIG. 3 is a side elevation of the sealing machine taken along line 3—3 of FIG. 2.

With reference to FIGS. 1, 2 and 3, there is shown a preferred embodiment of the sealing machine 10 of the present invention. Sealing machine 10 includes an endless conveyor 12 which carries filled containers 14 in a row (shown as a single row to facilitate illustration) along a horizontal line of movement below applicator wheel 16 which applies closures 18 to the filled containers 14. Applicator wheel 16 includes a plurality of closure carriers 20 about its periphery which receive closures 18 from a closure feeding star wheel 22 at a first rotational position (designated by 21 in FIG. 1) of applicator wheel 16. The carriers 20 successively apply the closures to the containers at a second rotational position (designated by 23) of the applicator wheel 16.

Sealing machine 10 may have a base or support structure 24 which is similar to those shown and described in U.S. Pat. Nos. 3,274,748, 3,348,174 and 4,279,115. Base structure 24 supports endless container conveyor 12 and is associated with an appropriate feed means (not shown) for feeding the containers 14 onto conveyor 12. As the containers move along conveyor 12, they are filled with the desired product by a suitable filler mechanism 26, which may be of any known type and which does not comprise any part of the invention.

The speed with which sealing machine 10 can be operated is enhanced by providing side conveyors 28 to engage and grip each of the containers 14 to carry them positively beneath applicator wheel 16. The side conveyors 28 each comprise an endless roller chain 30 (or alternatively a timing gear belt), having a plurality of arcuate, notched resilient container gripping members 31 fastened thereto to engage each container from opposite sides and ensure that it is positioned in predetermined spacing on conveyor 12 relative to applicator wheel 16.

Closure carriers 20 are positioned about the periphery of applicator wheel 16 and circumferentially spaced a distance from one another which corresponds to the linear distance between the adjacent containers held by container grippers 31 on side conveyors 28 as the containers are moved by endless conveyor 12. Furthermore, applicator wheel 16 is rotated at a speed such that the linear speed of the closures 18 engaged by closure carriers 20 corresponds to the linear speed of the containers 14 on conveyor 12. By synchronizing the rotation of applicator wheel 16 with the movement of conveyor 12 and side conveyors 28, proper convergence of closures 18 engaged by closure carriers 20 and containers 14 is assured.

Closures 18 are fed to closure carriers 20 on applicator wheel 16 by means of star wheel 22. Star wheel 22 rotates about an axis perpendicular to the axis of applicator wheel 16 and feeds the closures to the closure carriers 20 at a first rotational position 21 of applicator wheel 16. Closures 18 are preferably fed to closure carriers 20 by star wheel 22 such that the plane of the closures 18 is parallel to the plane of star wheel 22 and perpendicular to the plane of the applicator wheel 16. This orientation of star wheel 22 and applicator wheel 16 facilitates easy transfer and pick up of closures 18 by closure carriers 20 and obviates the need to reorient the planes of the closures 18 during the feeding operation. As shown in FIGS. 1 and 3, first rotational position 21 of applicator wheel 16 whereat the closures are fed to the closure carriers is preferably at the nine o'clock position. It will be appreciated, however, that closures 18 may be fed to closure carriers 20 at any other desired rotational position of applicator wheel 16 which does not interfere with the application of the closures to the containers.

Figure 4:
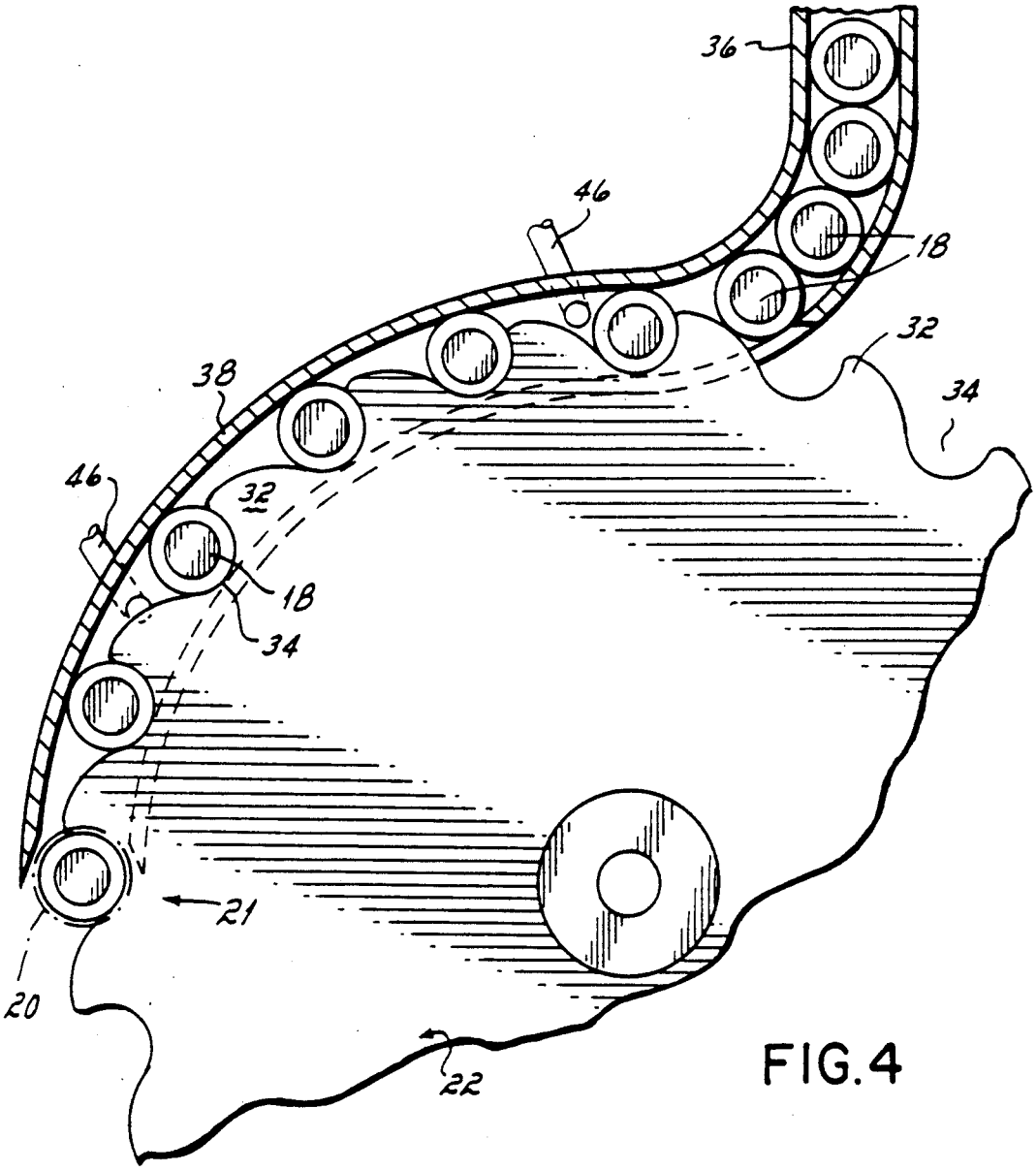
FIG. 4 is a side elevation, partially broken away, of a star wheel, taken along line 4—4 of FIG. 3.

A preferred embodiment of star wheel 22 is shown in FIGS. 1 and 4. Star wheel 22 has a plurality of lobes or teeth 32 about its periphery which define closure-receiving notches or pockets 34 between them. Closures 18 are fed to star wheel 22 via closure feed chute or slide 36, which guides the closures from a closure supply (not shown). The closures drop by gravity or spring feed from feed chute 36 into the closure-receiving pockets 34 as star wheel 22 is driven in rotation. The teeth 32 of the star wheel are rounded to lower the closures into the pockets following it; the face of the following tooth may have a slight overhang to capture the closure in the preceding pocket and prevent the next closure from falling into the preceding pocket. Closure guideway 38 communicates with closure feed chute 3 and is positioned adjacent and corresponds to the perimeter of star wheel 22. Closure guideway 38 serves to confine and guide closures 18 in closure-receiving pockets 34 as star wheel 22 rotates toward the location whereat the closures are presented to and engaged by closure carriers 20 on applicator wheel 16. Closures 18 are confined, guided and fed to applicator wheel 16 by the cooperative action of closure guideway 38 and star wheel 22 with the closures 18 positioned in a plane parallel to the plane of star wheel 22 at the transfer position.

Star wheel 22 and applicator wheel 16 are positioned relative one another (with perpendicular axes of rotation) such that the closure-receiving pockets 34 and closure carriers 20 on applicator wheel 16 are brought into convergence at a first rotational position 21 of the applicator wheel as the star wheel 22 and applicator wheel 16 are rotated. Preferably, star wheel 22 and applicator wheel 16 are rotated in synchronism with one another and with conveyor 12 and side conveyors 28, by utilizing a single drive mechanism 40 which drives each of these respective components by way of a suitable gear and chain (or timing belt) arrangement designated generally as 42.

In one embodiment of the present invention, wherein closures 18 are pressed onto the finish of the containers 14 to an at least partially applied position, applicator wheel 16 is positioned a predetermined distance above conveyor 12 (which distance is dictated by the height of the containers being sealed) such that as applicator wheel 16 rotates the closures carried by closure carriers 20 converge with and are pressed onto the finish of containers 14 at a second rotational position 23 of applicator wheel 16, which is the six o'clock position. This is shown more clearly in FIGS. 6 and 7. In this embodiment, the closures are preferably of the plastic or composite plastic/metal type so that the closures can be pressed onto the container finish without damaging or breaking either the closure or the container.

Sealing machine 10 preferably includes a steam jacket 44 through which filled containers 14 pass as they are moved by conveyor 12 prior to passing under applicator wheel 16. Steam is fed to steam jacket 44 via a steam feed line 46, which also supplies steam to closure guideway 38. The steam serves several purposes. It heats the container finish and may be used to sterilize the containers prior to sealing. The steam fed to closure guideway 38 also serves to soften the plastic closures to a sufficient degree that they can be easily pressed onto the container finish without damage to the container or to the closure itself. Additionally, where tamper indicating bands are formed on the lower portion of the closures, the steam heating softens these bands and facilitates their movement over retention beads on the containers being sealed, without disrupting or breaking the bands. Furthermore, once the closures have been applied to the containers, a sealing vacuum is formed upon cooling of the container and closure due to the contraction thereof which naturally occurs upon cooling.

In an alternative embodiment, wherein sealing machine 10 is used to apply metal or other closures onto containers and it is not desired or feasible just to press the closures onto the containers, applicator wheel 16 is positioned a predetermined distance above conveyor 12 such that the closures are brought into converging alignment with the containers as applicator wheel 16 rotates and are positioned on (but not pressed down over) the finish threads on containers 14.

Figure 5:
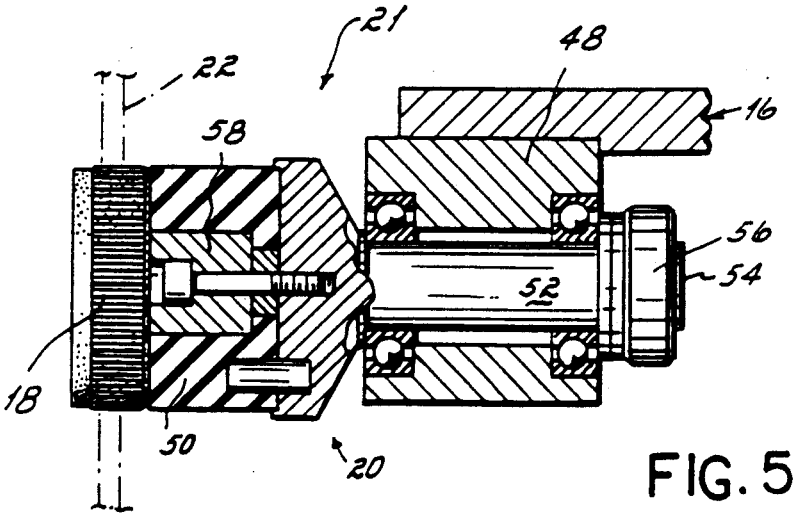
FIG. 5 is an enlarged view, in partial cross section, of one embodiment of a closure carrier, taken along line 5—5 of FIG. 3.

FIG. 5 shows a preferred embodiment of a closure carrier 20 as it engages a closure 14 supplied by star wheel 22. In this embodiment, carrier 20 is rigidly fixed to applicator wheel 16 at the periphery thereof by a carrier bracket 48 which is secured on applicator wheel 16. Carrier 20 includes a chuck portion 50 for engaging a closure and a stem portion 52 which is received by carrier bracket 48. Stem portion 52 preferably has a threaded end segment 54 for receiving a nut 56 to secure carrier 20 to carrier bracket 48 while facilitating easy replacement of the carriers if they become damaged or other sizes are required.

Figure 6:
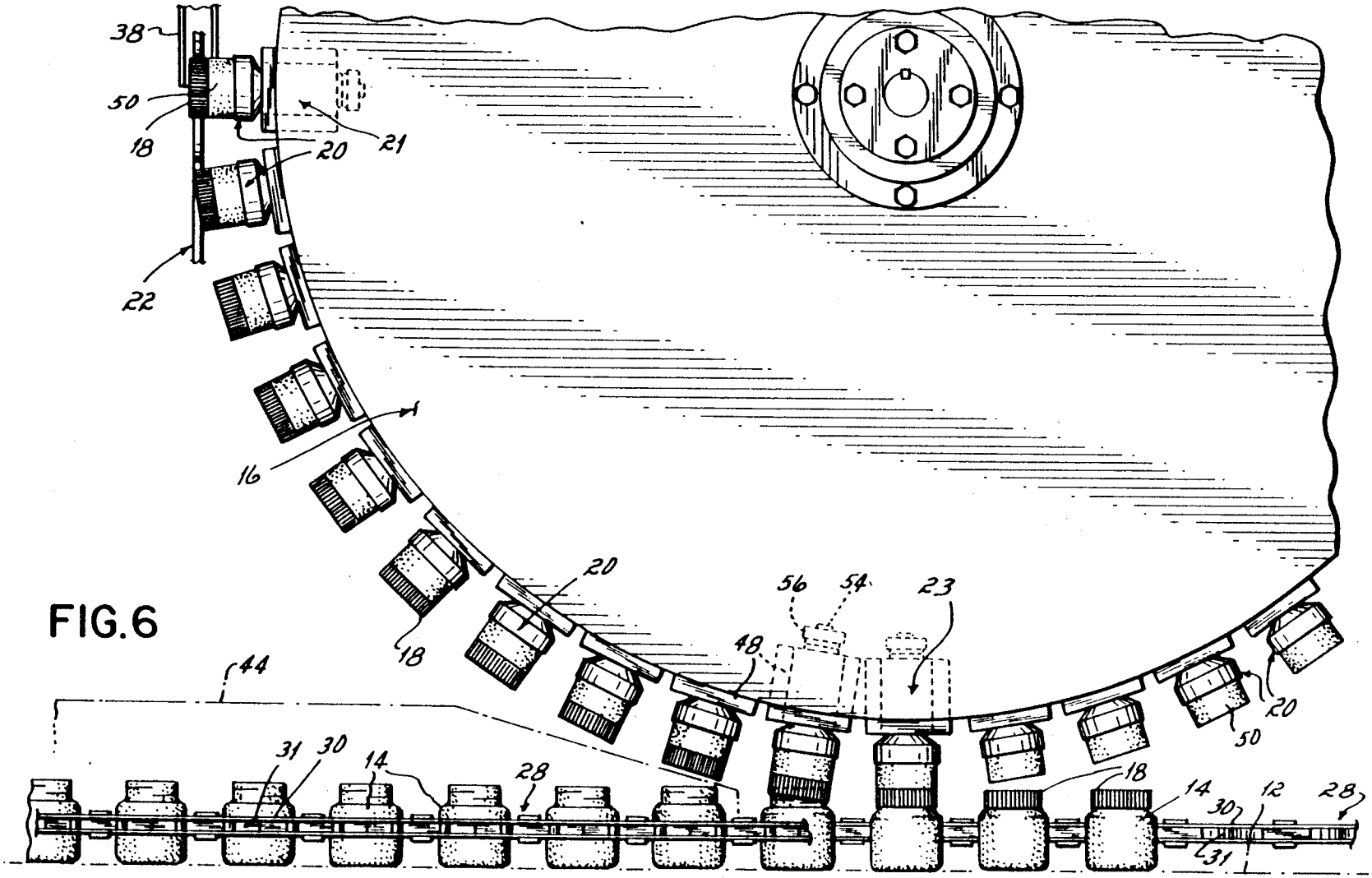
FIG. 6 is an enlarged side elevation, partially broken away, of an applicator wheel, taken along line 6—6 of FIG. 2.
Figure 7:
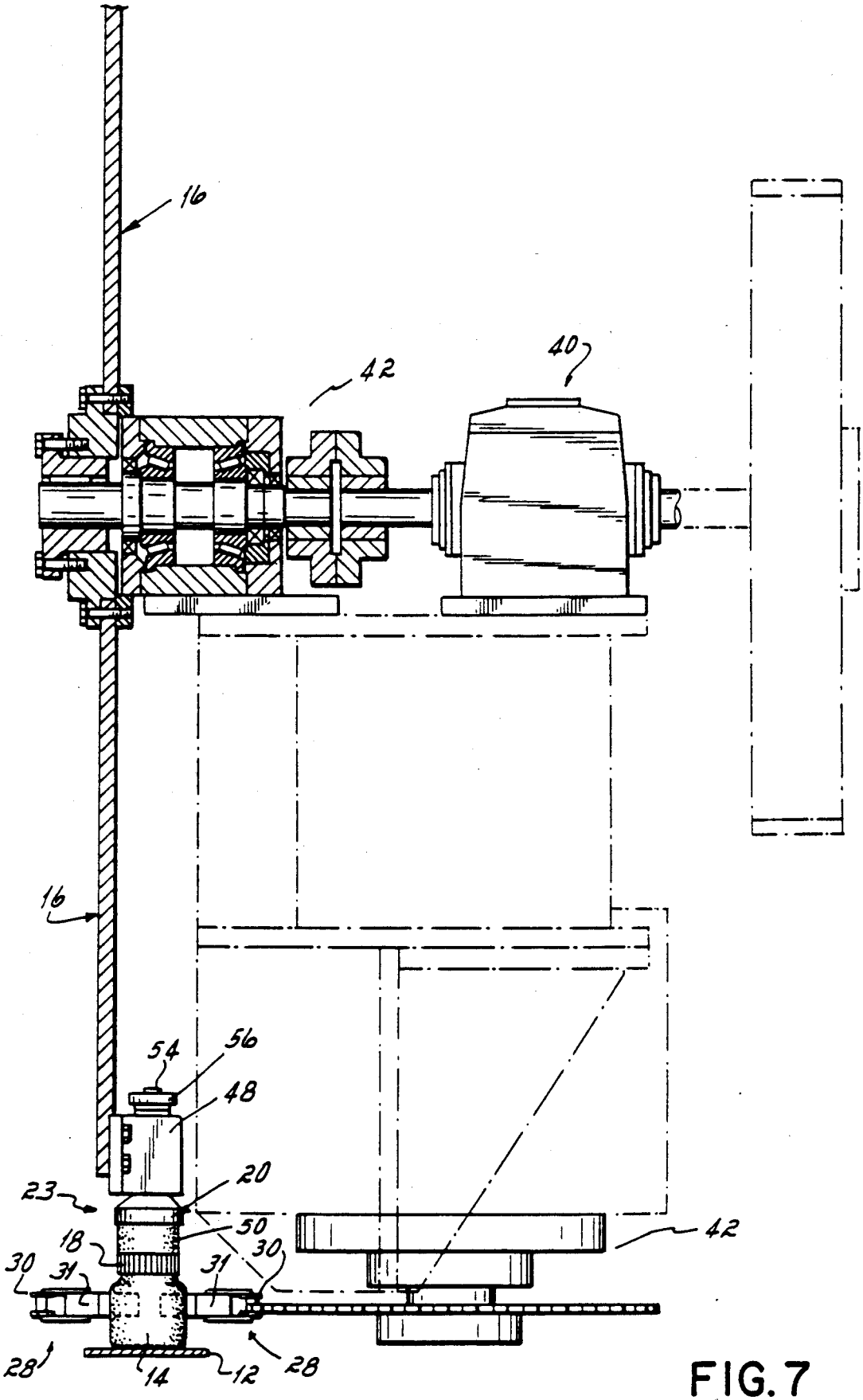
FIG. 7 is a partial cross section taken along line 7—7 of FIG. 3, and shows the drive mechanism of the sealing machine.

Chuck portion 50 of carrier 20 is preferably cylindrical and has a diameter substantially the same as that of the closures it carries. Additionally, chuck portion 50 has a centrally disposed permanent magnet 58 to draw and retain metal closures and composite closures having a metal disk cap as the closures are presented by star wheel 22. As the closures and carriers converge at the first rotational position 21 of applicator wheel 16, the magnet 58 cooperates with the metal closure to engage the closure and remove it from the closure pocket 34 of star wheel 22 as the two wheels rotate. As can be seen, the star wheel pockets move in a plane perpendicular to the plane in which the carriers 20 move; each closure 14 is thus presented face-on to magnet 58, so that it is grasped and moves smoothly from the star wheel plane of rotation into the perpendicular plane of rotation of the applicator wheel. Moreover, the transfer is smooth and positive, because the closures are carried by the star wheel pockets to the carriers 20. Carrier 20 thereby carries closure 14 along a downwardly curving path to the location whereat the closure converges with a container and is pressed thereon (FIG. 6). As carrier 20 diverges from container 14 (due to the rotational motion of applicator wheel 16 and the linear motion of conveyor 12), the containers now with the closures secured on them are moved linearly by the gripping members on the conveyors 28. The magnetic engagement between carrier 20 and closure 18 is thereby broken. Thus, the closure carriers 20 are empty and ready to engage following closures when they again rotate through the first rotational position 21 of applicator wheel 16.

Once closures 18 are seated on containers 14, either pressed partially on or not pressed on, the closures may be rotated or twisted to a final applied position, thereby sealing the containers. Various means are known for imparting rotation to a closure once it is seated on a container. One such means is a twin side belt unit 60 which comprises a pair of differentially speeded belts parallel to the line of movement of the conveyor which engages opposite sides of the closures as the containers and closures pass therebetween, to rotate the closures on the container finish. FIG. 1 shows twin side belt unit 60 "downstream" from applicator wheel 16. It will be appreciated that such a twin side belt unit may be positioned at the second rotational position of applicator wheel 16 such that the opposed side belts 62, 64 engage both the closures and closure carriers 20 as the closures are seated or pressed onto containers 14.

Typically, a secondary and final tightening unit is used to rotate closures 18 to their final applied position on containers 14. One suitable means to accomplish this is a belt and drag shoe unit 66. This unit comprises a stationary friction pad or drag shoe 68 and an adjacent rotating belt 70, both of which extend longitudinally above conveyor 12. The principle of operation of the belt and drag shoe unit is straightforward. As the conveyor moves containers 14 underneath the belt and drag shoe unit 66, the drag shoe frictionally engages a portion of the side surface of closure 18 thereby tending to rotate it relative to the container. Concurrently, rotating belt 70 engages the diametrically opposite side of closure 18, also tending to rotate the closure. The belt and drag shoe unit can be calibrated such that the closures are rotated on the container finish to a predetermined torque which corresponds to the final applied position of the closures, to thereby seal the containers 14.

Figure 8:
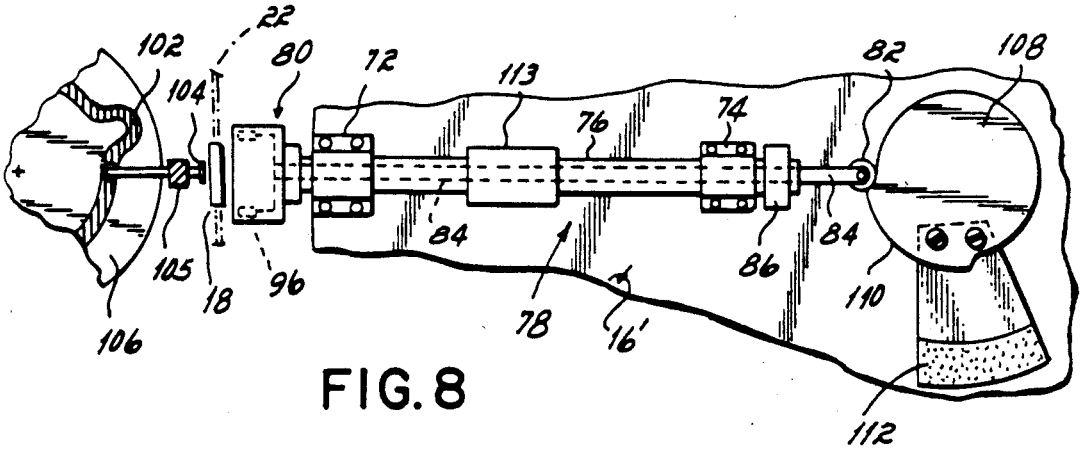
FIG. 8 is a side elevation, partially broken away, of an alternate embodiment of an applicator wheel, spindle, closure carrier and closure feed mechanism in a first rotational position of the applicator wheel.
Figure 10:
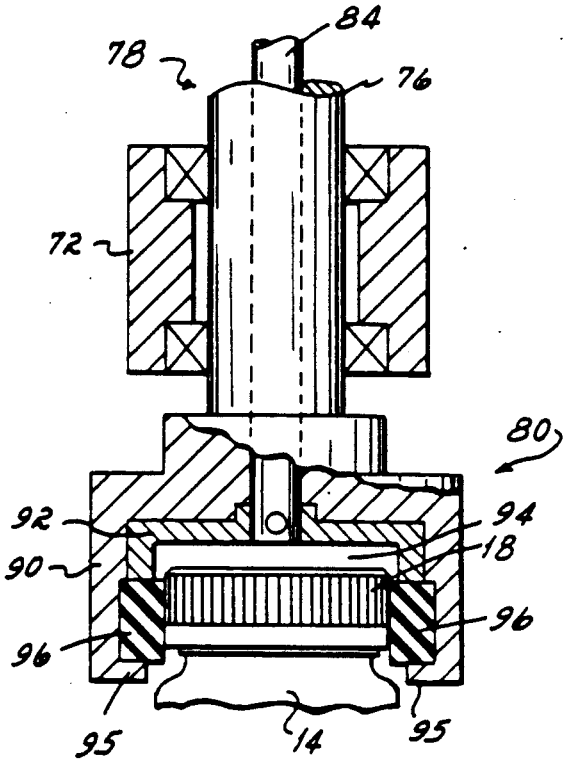
FIG. 10 is an enlarged view, in partial cross section, of the closure carrier shown in FIGS. 8 and 9.
Figure 9:
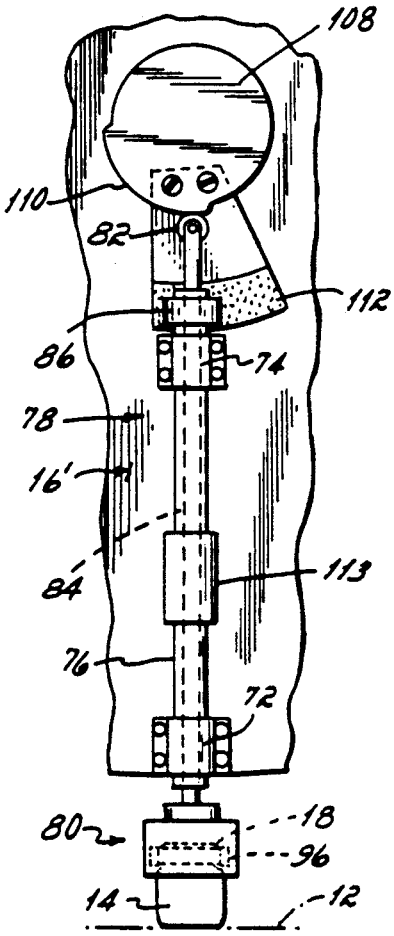
FIG. 9 is a side elevation, partially broken away, of the applicator wheel, spindle and closure carrier shown in FIG. 8 in a second rotational position of the applicator wheel.

FIGS. 8, 9 and 10 show an alternative applicator wheel and closure carrier combination. Applicator wheel 16' has two brackets 72, 74 attached thereto in radial alignment. Brackets 72, 74 rotatably receive outer shaft 76 of carrier spindle 78. Spindle 78 has a closure carrier 80 affixed to its distal end and a cam follower wheel 82 rotatably coupled to the proximal end of an inner shaft 84 which is axially slidable in outer shaft 76; cam follower wheel 82 tracks on a fixed cam 108. Additionally, spindle 78 has a wheel 86 affixed to and coaxial with outer shaft 76.

Carrier 80 has an outer sleeve 90 which is coupled to outer shaft 76. Coupled to the inner shaft 84 is an inner sleeve 92, concentric with outer sleeve 90, which defines a cylindrical cavity 94 for receiving a closure therein. Inner sleeve 92 includes a compressible rubber or frictional annular ring 96 having a center opening for frictionally engaging a closure 18. The ring 96 is captured in cavity 94 by a retaining flange 95 on the outer end of outer sleeve 90.

As shown in FIG. 8, when applicator wheel 16' is in a first rotational position 21, carrier 80 converges onto a closure 18 carried by star wheel 22 so that the ring 96 surrounds the closure. As the applicator wheel rotates, cam follower 82 comes into the lobe 110 of cam 108. This pushes inner shaft 86 outwardly, which in turn compresses the rubber ring 96 against flange 95. Unable to move axially outward, the ring is squeezed inwardly so that the closure is gripped in the center opening of the ring.

It is also contemplated that the carriers can be moved axially as well as rotationally about their axis. Axial movement enables the carriers to be engaged with the closure at an earlier position along the conveyor, and to be held longer for rotation. Such axial movability is discussed more fully below.

One suitable means by which carrier 80 engages closure 18, is by the action of a synchronized pusher 104 which pushes the closure from the star wheel 22 into the carrier, as they pass at the point of closest convergence In the embodiment shown in FIG. 8 for purposes of illustration, the pusher 104 is slidably mounted to a frame member 105. A disk 106 that rotates in synchronism with the star wheel has a cam track 102 (or another timing device) which operates the pusher. The cam lobe 110 of cam 108 is shaped to cause the closure to be held in the carrier ring 96 as described above from the first rotational position 21 of the applicator wheel, at which location it is first received, to the second rotational position 23, at which location it is released.

Additionally, wheel 86 on spindle 78 engages a fixed roller pad 112, thereby imparting rotational motion to outer shaft 76 and closure carrier 80 thereby to rotate closure 18 onto the container finish. The maximum torque applied to the closure is limited by a clutch 113 in spindle 78, which prevents overtightening. As applicator wheel 16' continues to rotate and container 18 moves linearly along conveyor 12, closure 18 is disengaged from closure carrier 80. Concurrent with this disengagement, cam wheel 82 rolls off cam lobe 110, and the rubber ring 96 opens to receive another closure when the applicator wheel again passes through the first rotational position.

Figure 11:
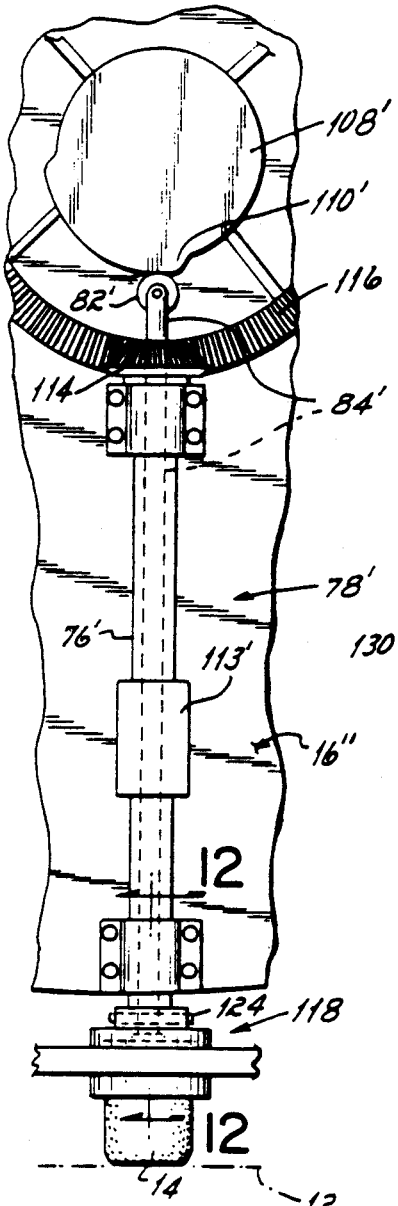
FIG. 11 is a side elevation, partially broken away, of another alternative applicator wheel, spindle and closure carrier.
Figure 12:
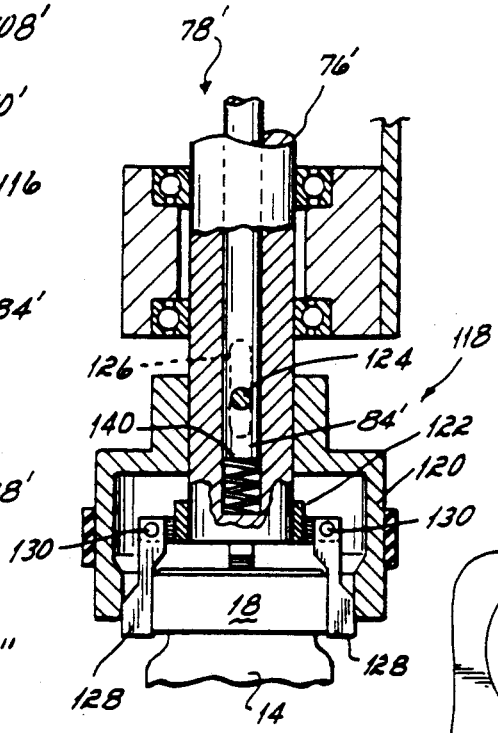
FIG. 12 is an enlarged view, in partial cross section, of a closure carrier in a first operative position taken along line 12—12 of FIG. 11.
Figure 13:
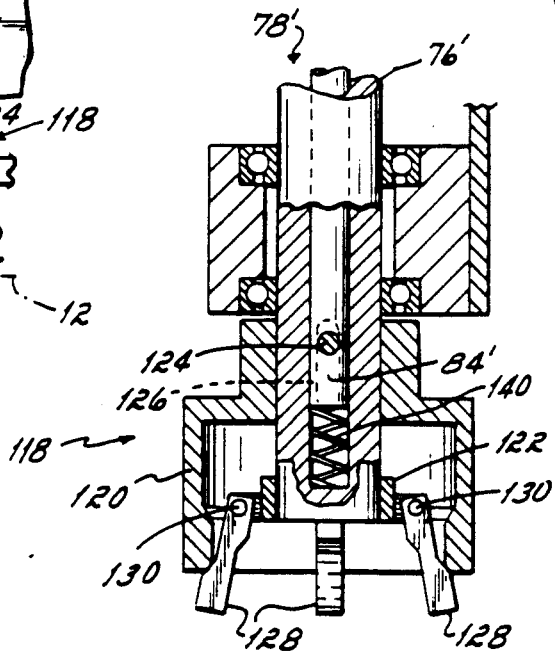
FIG. 13 is an enlarged view, in partial cross section, of the closure carrier shown in FIG. 12 in a second operative position.

FIGS. 11, 12 and 13 show an alternative applicator wheel, spindle and closure carrier arrangement. In this embodiment, spindle 78' has a gear wheel 114 rather than a roller, and fixed cam 108' has a fixed gear track 116 attached thereto with which gear wheel 114 meshes to impart rotation to spindle 78' and closure carrier 118. Fixed gear track 116 preferably extends completely around fixed cam 108' so that gear wheel 114 and spindle 78' rotate continuously. This eliminates any possibility of slippage or improper meshing. Fixed cam 108' includes a cam lobe 110' upon which cam follower wheel 82' rides when applicator wheel 16" is rotated. In this embodiment, cam lobe 110' provides a radial reciprocation of inner shaft 84'. This reciprocation causes closure carrier 118 to move between a closure engaging attitude and a closure releasing attitude.

With particular reference to FIGS. 12 and 13, closure carrier 118 has a rotatable outer sleeve 120 and an inner closure gripping portion 122. Inner closure gripping portion 122 is fixed to the distal end of outer shaft 76' of spindle 78'. Outer sleeve 120 is connected to reciprocating inner shaft 84' by pin 124 through slot 126 in outer shaft 76'.

Inner closure gripping portion 122 includes closure gripping fingers 128 which are pivotable about pins 130. As applicator wheel 16" rotates to a first rotational position 21 whereat closure carrier 18 engages and withdraws a closure IB from star wheel 22, cam follower wheel 82' comes onto cam lobe 110' thereby urging inner shaft 84' radially outwardly compressing spring 40 such that sleeve 120 pushes the closure gripping fingers 128 inwardly into engagement with a closure. The engagement of gear wheel 114 and fixed gear track 116 rotates closure carrier 118 and the closure therein and when closure 18 converges with container 14 as applicator wheel 16" rotates into its second rotational position 23 (i.e., the closure applicating position) closure 18 is twisted onto the finish of container 14 As applicator wheel 16" continues to turn and closure carrier 118 diverges from container 14, cam roller 82' rides off cam lobe 110'. Inner shaft 84' then moves radially inward due to the action of spring 40 thereby shifting outer sleeve 120 from its closure gripping relationship with fingers 128. By way of spring or other biasing (not shown) fingers 128 swing pivotally away from closure 18 thereby releasing it.

Figure 14:
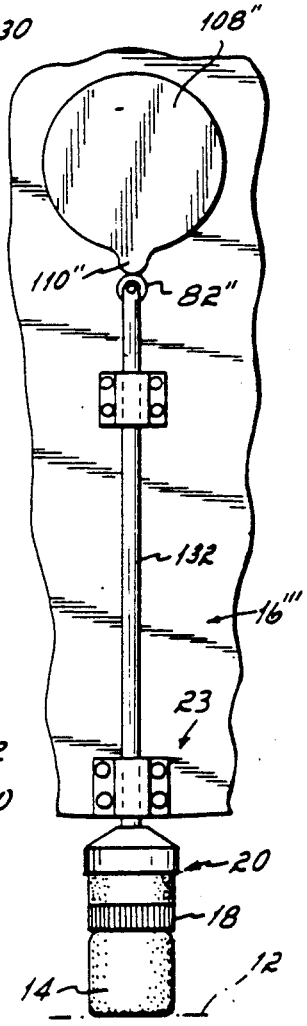
FIG. 14 is a side elevation, partially broken away, of another alternative applicator wheel, spindle and the closure carrier.

FIG. 14 shows another alternative embodiment in which closures 18 are pressed on the finish of a container 14 by the action of a reciprocating spindle shaft 132. In this embodiment, applicator wheel 16''' has a reciprocating spindle shaft 132 mounted thereon. Shaft 132 has a closure carrier 20 preferably of the type shown in FIG. 5 affixed at its distal end and a cam follower wheel 82" at its proximal end. Shaft 132 is axially reciprocated by the action of cam follower wheel 82" riding up on cam lobe 110" of fixed cam 108". Thus, when applicator wheel 16''' rotates through its second rotational position 23, closure 18 is pressed onto container 14 by the action of cam lobe 110".

In the preferred form of this invention, the closures are transferred from the star wheel 22 to carriers which are mounted on an applicator wheel 16 in the form of a circular disk. However, it is contemplated that, alternatively, the carriers could be moved tangentially into contact with the containers by a continuous loop belt in the form of a circle, oval, or elipse. The term wheel, as used herein is intended to include these alternative noncircular forms.

It will be appreciated by persons skilled in the art that various modifications may be made to the various structural elements of the present invention without departing from the spirit of the present invention, the scope of which is defined by the appended claims.

What is claimed is:

1. A machine for placing closures onto containers each having a finish, comprising:

a conveyor for moving the containers in a row along a linear path of movement;

an applicator wheel rotatable about an axis transverse to the path of movement of said conveyor, said applicator wheel spaced above said conveyor;

said applicator wheel having a plurality of closure carriers around it;

drive means for continuously rotating said applicator wheel in synchronism with said conveyor such that the linear speed of said carriers matches that of the containers on said conveyor;

means for feeding closures from a source to said carriers on said applicator wheel at a first rotational position of said applicator wheel, said feeding means comprising a closure feeding wheel which rotates about an axis perpendicular to the axis of said applicator wheel in synchronism with said applicator wheel, said closure feeding wheel having means around its periphery for receiving and carrying closures, and a supply for delivering closures to said closure receiving and carrying means, whereby rotation of said closure feeding wheel moves the closures to said carriers on said applicator wheel, said carriers receiving the closures from said closure receiving and carrying means;

each carrier having gripping means for engaging a closure as said applicator wheel rotates through said first position;

further rotation of said applicator wheel moving the closures carried by said carriers sequentially into convergence with tops of the respective containers as the conveyor advances the containers;

the spacing of said applicator wheel above said conveyor being such that each closure is placed onto the finish of a respective container in a partially applied position as the closure converges with the container.

2. The machine of claim 1 wherein said closure gripping means engages and withdraws a closure from said closure receiving and carrying means as said applicator wheel rotates through said first rotational position.

3. The machine of claim 1 wherein said closure feeding wheel carries the closures in an orientation wherein the plane of each closure is parallel to the plane of said closure feeding wheel.

4. The machine of claim 1 further including means for rotating each said closure about the axis thereof subsequent to each closure being placed onto the container finish, to further tighten the closure on the container finish.

5. The machine of claim 4 wherein said closure rotating means comprises differentially speeded belts parallel to the line of movement of said conveyor for engaging opposite sides of the closures to rotate the closures on the container finish.

6. The machine of claim 5 further comprising secondary rotating means for rotating each said closure on a respective container finish to a final applied position.

7. The machine of claim 6 wherein said secondary rotating means is a belt and drag shoe unit calibrated to rotate each said closure to a predetermined torque.

8. A machine for placing closures onto containers having a finish, comprising:

a conveyor for moving the containers in a row along a linear path of movement;

an applicator wheel spaced above said conveyor and rotatable about an axis transverse to the line of movement of said conveyor;

said applicator wheel having a plurality of spindles extending axially outwardly from said axis of rotation of said applicator wheel, each said spindle having a closure carrier at its distal end;

drive means for continuously rotating said applicator wheel in synchronism with said conveyor such that the linear speed of said carriers matches that of the containers on said conveyor;

means for feeding closures from a source to said carriers on said applicator wheel spindles at a first rotational position of said applicator wheel, said feeding means comprising a closure feeding wheel which rotates about an axis perpendicular to the axis of said applicator wheel in synchronism with said applicator wheel, said closure feeding wheel having means around its periphery for receiving and carrying closures, and a supply for delivering closures to said closure receiving and carrying means, whereby rotation of said closure feeding wheel moves the closures to said carriers, said carriers receiving the closures from said closure receiving and carrying means;

each carrier having gripping means for engaging a closure as said applicator wheel rotates through said first position;

further rotation of said applicator wheel moving the closures carried by said carriers sequentially into convergence with the tops of the respective containers as the conveyor advances the containers;

the spacing of said applicator wheel above said conveyor being such that each closure is placed onto the finish of a respective container in a partially applied position as the closure converges with the container.

9. The machine of claim 8 further including means for rotating each said closure about the axis thereof subsequent to each closure being placed onto the container finish to further tighten the closure on the container finish.

10. The machine of claim 9 wherein said closure rotating means comprises differentially speeded belts parallel to the line of movement of said conveyor for engaging opposite sides of the closures to rotate the closures on the container finish.

11. The machine of claim 10 further including secondary rotating means for rotating each said closure on a respective container finish to a final applied position.

12. The machine of claim 11 wherein said secondary closure rotating means is a belt and drag shoe unit calibrated to rotate each said closure to a predetermined torque.

13. The machine of claim 8 wherein said closure feeding wheel carries the closures in an orientation wherein the plane of each closure is parallel to the plane of said closure feeding wheel.

* * * * *